United States Patent [19]

Rudell et al.

[11] 4,333,655

[45] Jun. 8, 1982

[54] MOUNTAIN CLIMBER GAME WITH MOVEABLY ATTACHED PIECES

[75] Inventors: Elliot A. Rudell, 2422 Curtis Ave., Redondo Beach, Calif. 90278; Joseph S. Cernansky, Manhattan Beach; Richard P. Kamrath, Redondo Beach, both of Calif.

[73] Assignee: Elliot A. Rudell, Lawndale, Calif.

[21] Appl. No.: 171,904

[22] Filed: Jul. 24, 1980

[51] Int. Cl.[3] ..... A63F 3/00

[52] U.S. Cl. ..... 273/241; 273/287; 273/249; 273/281

[58] Field of Search ..... 273/241, 287, 249, 283, 273/393, 383

[56] References Cited

U.S. PATENT DOCUMENTS

| | | | |
|---|---|---|---|
| 1,559,171 | 10/1925 | Knowles | 273/393 X |
| 2,231,640 | 2/1941 | Rubin | 273/344 X |
| 2,729,451 | 1/1956 | Larson | 273/241 X |
| 3,083,020 | 3/1963 | Terschak | 273/241 |
| 3,232,620 | 2/1966 | Schoolcraft et al. | 273/239 |
| 3,428,320 | 2/1969 | Yurkinas | 273/393 X |
| 3,792,865 | 2/1974 | Credico, Jr. et al. | 273/258 |
| 3,913,920 | 10/1975 | Brummit | 273/282 X |
| 4,157,183 | 6/1979 | Meyer et al. | 273/243 |

FOREIGN PATENT DOCUMENTS

| | | | |
|---|---|---|---|
| 559008 | 1/1944 | United Kingdom | 273/298 |
| 941174 | 11/1963 | United Kingdom | 273/241 |

*Primary Examiner*—Richard C. Pinkham
*Assistant Examiner*—Scott L. Brown
*Attorney, Agent, or Firm*—Ross, Ross & Flavin

[57] ABSTRACT

A board game includes an upright playing surface representative of a mountain having trails or paths thereon with openings for releasably receiving playing pieces, there being missiles or other hazards slidably or movably related to the mountain and which are adapted to strike the playing pieces to physically knock them off of the mountain.

3 Claims, 2 Drawing Figures

MOUNTAIN CLIMBER GAME WITH MOVEABLY ATTACHED PIECES

BACKGROUND OF THE INVENTION

1. Field of the Invention

The invention relates to board games, and more particularly to board games of the type wherein playing pieces are moved along a path or paths according to instructions contained on playing cards.

2. Description of the Prior Art

Board games utilizing playing pieces movable along a path or paths according to instructions contained on playing cards are well known. However, to our knowledge, it is not known to employ the use of slidable or movable hazards or missiles to physically remove the playing pieces from the playing board.

SUMMARY OF THE INVENTION

An object of the invention is to provide an upright playing surface representative of a mountain having trails or paths thereon with openings for releasably receiving playing pieces, there being missiles or other hazards slidably or movably related to the mountain and which are adapted to strike the playing pieces to physically knock them off of the mountain.

DESCRIPTION OF THE PREFERRED EMBODIMENT

Figure 1:
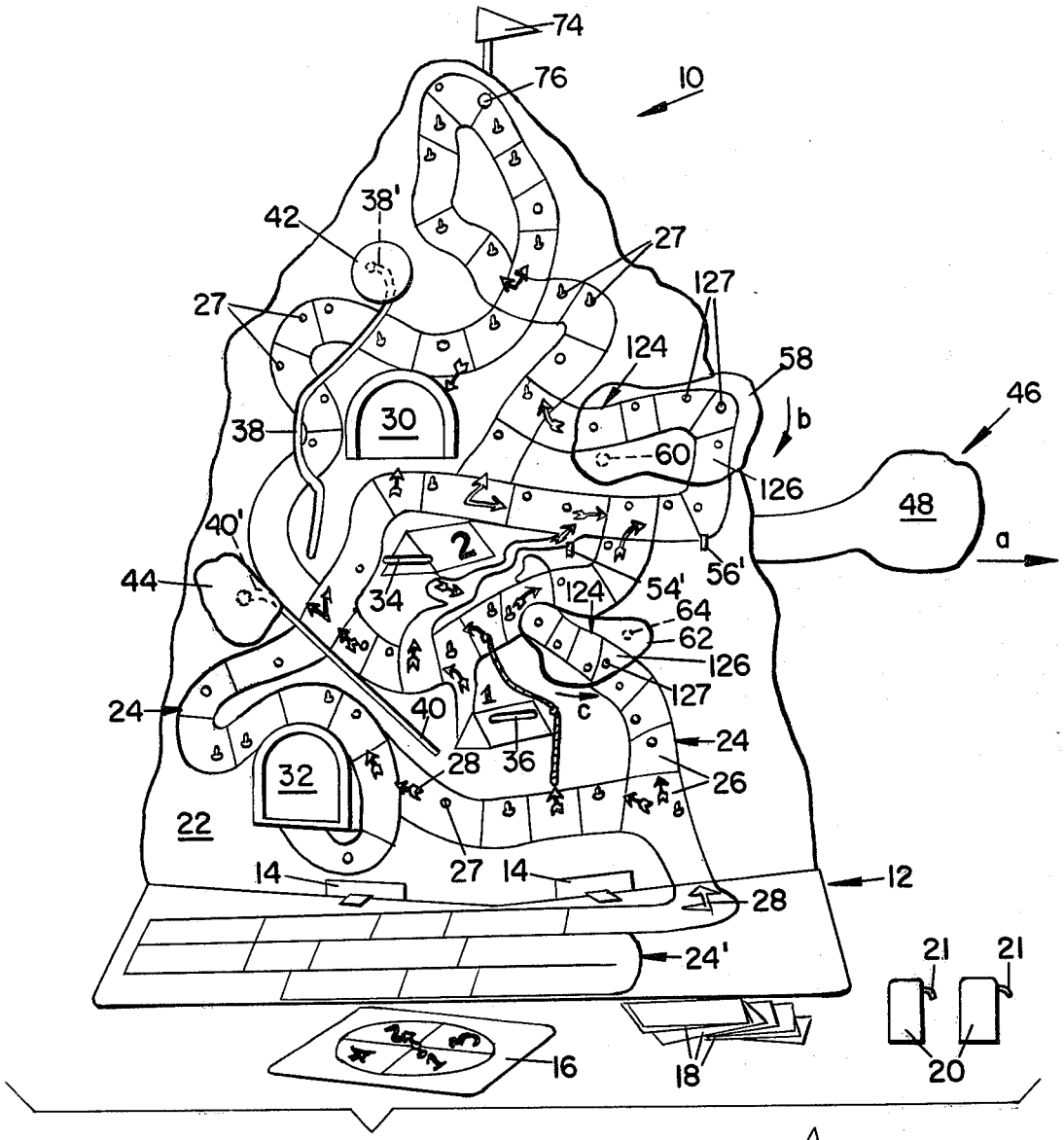
FIG. 1 is an elevational perspective view of the several components of the game apparatus.

The game includes an upright playing board 10 in the shape of a mountain held in an upright position by a lower gameboard or base 12 extending outwardly therefrom and releasably fixed to its lower end as by clips 14.

Also included are a spinner 16, a plurality of playing cards 18, and playing pieces 20 having hook-like hole engaging members 21 adjacent their upper ends.

Playing board 10 includes a front planar playing surface 22 having a plurality of playing paths or trails 24 each including playing squares 26 printed thereon, the playing paths winding in serpentine manner from the base of the mountain to its peak and converging at their lower ends with a playing path 24' printed on the upper face of base 12.

Holes 27 extend through the playing board at each of the playing squares 26 and are adapted to receive therein the hook-like hole engaging members 21 of playing pieces 20.

A plurality of arrows 28 indicate the various options in directions of movement along the playing paths 24 available to the players.

Playing squares 26 and playing cards 18 will have indicia, not shown, printed thereon, for purposes as will appear.

Upper and lower cup-like members 30 and 32 respectively provide openings representing caves which extend through playing board 10 from front playing surface 22 to the rear surface.

Horizontally-disposed upper and lower slots 34 and 36 respectively are cut through playing board 10 adjacent the representations of a pair of tents indicated by the numerals 2 and 1 respectively.

A first substantially vertically disposed slot 38, having an offset portion 38' at its upper ends is cut through playing board 10 and passes through several of the playing squares 26 of playing paths 24.

A second angularly disposed slot 40, having an offset portion 40' at its upper end, is cut through playing board 10 and passes through other of the playing squares of playing paths 24.

A first guided missile 42 in the form of a flat disc is mounted on the front playing surface 22 for slidable movement between an upper position wherein it rests in offset portion 38' of first slots 38 and a lower position, wherein it rests at the lower end of slot 38.

A second guided missile 44 in the form of a flat rectangular piece is mounted on the front playing surface for slidable movement between an upper position wherein it rests in offset portion 40' of second slot 40 and a lower position, wherein it rests at the lower end of slot 40.

A limb 46 is mounted for horizontally slidable movement relative to playing board 10.

Limb 46 includes a flat manually enagageable rectangular handle portion 48 which extends outwardly beyond the outer edge of playing board 10 and is affixed at its inboard end to a flat horizontally arranged slide portion 50 mounted for sliding movement relative to the rear surface 52 of the playing board.

Slide portion 50 of limb 46 is provided with a pair of spaced axially-aligned longitudinally-extending slots 54 and 56 in which a pair of spaced guides 54' and 56' respectively are receivable, the guides extending rearwardly from rear surface 52 of the playing board, all whereby limb 46 may be moved horizontally relative to the playing board with the slots sliding relative to the guides.

Figure 2:
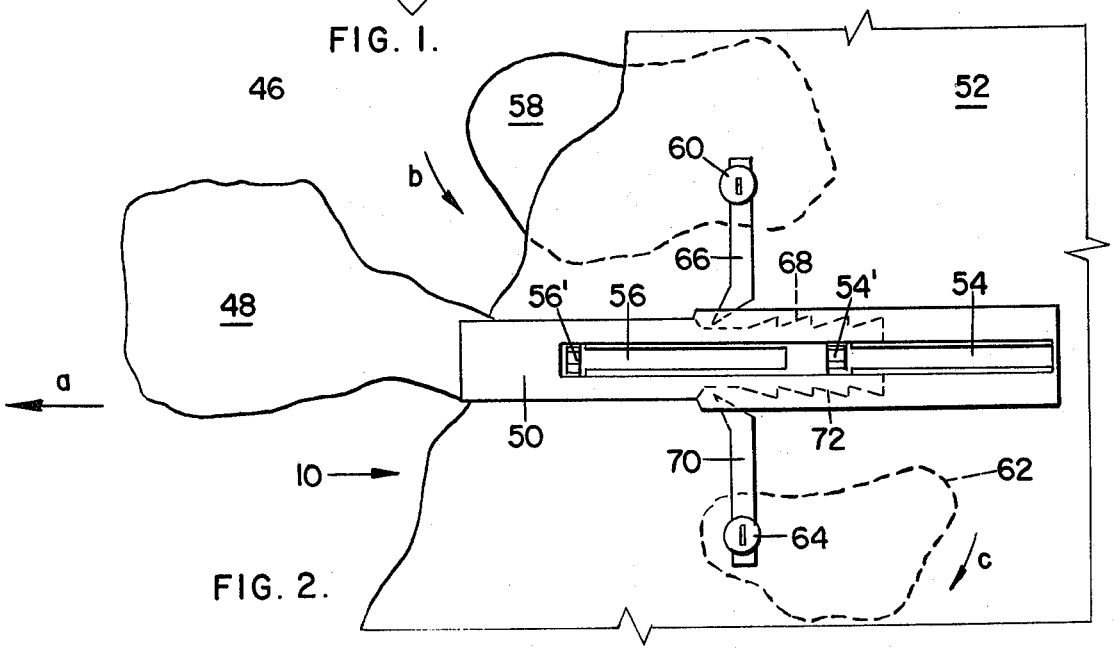
FIG. 2 is an enlarged, fragmentary rear elevational view of certain of the game components.

As best seen in FIG. 2, an upper rock 58 in the form of a flat rectangular piece is mounted by means of a pivot 60 to the front surface 22 of the playing board above limb 46 and a lower rock 62 in the form of a flat rectangular piece is mounted by means of a pivot 64 to the front surface 22 of the playing board below limb 46.

The upper and lower rocks have playing paths 124 imprinted on their outwardly-facing planar surfaces, which playing paths are adapted to be placed in register with playing paths 24 on playing board 10.

The playing paths 124 also contain playing squares 126 and playing piece receiving holes 127.

An upper pawl 66 depends from pivot 60 of upper rock 58 at the rear surface 52 of the playing board and engages with an upper ratchet portion 68 provided on the inboard face of slide portion 50 of limb 46.

A lower pawl 70 extends upwardly from pivot 64 of lower rock 62 at the rear surface 52 of the playing board and engages with a lower ratchet portion 72 provided on the inboard face of slide portion 50 of limb 46.

As the handle portion 48 is grasped and moved in the direction of arrow a in FIG. 2, the pawls 66 and 70 move along the ratchets 68 and 72 respectively and the upper rock 58 and lower rock 62 remain in a substantially horizontal disposition.

When the pawls reach the ends of the ratchet portions, they are no longer supported, whereupon the upper rock swings on pivot 60 in the direction of arrow b and the lower rock swings on pivot 64 in the direction of arrow c.

A winner's flag 74 is mounted by a pivot 76 to the playing board at the summit of the mountain.

GAME PLAY

OBJECT

To be the first player to reach the top of the mountain.

PREPARATION

1. Each player picks a playing piece 20 and places it on START on the lower gameboard or base 12.

2. The playing cards 18 are shuffled and placed in a stack beside the gameboard.

3. Limb 46 is loaded by pushing the limb inwardly toward the mountain until it stops. Upper and lower rocks 58 and 62 are then pivoted so that the gamepaths 124 on the rocks line up with the gamepaths 24 on the mountain.

4. Guided missiles 42 and 44 are slid upwardly in their slots 38 and 43 respectively until they remain in place in the offset portions 38' and 40'.

5. Winner's flag 74 is pivoted downwardly behind the mountain.

PLAY

1. The players spin the spinner 16, with the highest number playing first. Play continues clockwise by number around the spinner.

2. Once a player's playing piece 20 has reached the mountain, it is held on the mountain by placing the hooks 21 in the holes 27 or 127 on the playing paths. A player may take any path he desires, but must always follow the direction of the arrows 28.

3. Once on the mountain, if a player's playing piece 20 lands on a space 26 or 126 occupied by another player, the player landing there goes ahead to the next unoccupied space, except that any number of playing pieces may be at tents 1 and 2 or at the caves 30, 32.

4. When a player lands on a space carrying the indicia "Climb Card", he picks the top card 18, does as instructed thereon, and then returns the card to the bottom of the stack.

OUT-ON-A-LIMB

When a player lands on a space or draws a card carrying the indicia "OUT-ON-A-LIMB", he moves the Limb 46 outwardly in the direction of arrow a one click. After four clicks, the two rocks 58 and 62 will pivot downwardly knocking nearby playing pieces 20 off the mountain. After the rocks pivot, they are reset.

RAM WATCHING

When a player lands on a space or draws a card carrying the indicia "GO RAM WATCHING", he moves his playing piece to the RAM WATCHING space, and the moves the missile 44 out of the offset 40' and lets it slide down its slot 40. Playing pieces 20 nearby will be knocked off the mountain. After the missile 44 falls, it is reset.

SNOWBALL

When a player lands on a space that says "SNOWBALL", he keeps his playing piece on the space he is on, and moves the missile 42 out of the offset 38' and lets it slide down its slot 38, knocking all nearby paying pieces 20 off the mountain. The SNOWBALL is then reset.

TENTS 1 or 2

Playing pieces knocked off the mountain at any time during the game go directly to Tents 1 or 2. Any number of playing pieces 20 can be in Tents 1 or 2 at one time.

CAVES

If a player is instructed to go to a CAVE, he places his playing piece in one of the caves 30 or 32 and the playing piece will exit at the bottom of the mountain. He must continue from there on his next turn.

WINNING

When a player reaches the summit of the mountain, he inserts the hook 21 of his playing piece 20 into highest hole 27 and raises the "WINNER FLAG" 74. To win, a player need not reach that last spot on exact count.

We claim:

1. A game comprising: an upright playing surface representative of a mountain having trails thereon and openings through the playing surface along the trails, playing pieces releasably engageable with the openings, a plurality of missiles movably related to the playing surface and adapted to contact the playing pieces for physically displacing from the representation of the mountain, and wherein certain of the missiles being slidably related to slots in the playing surface.

2. A game according to claim 1, wherein certain of the missiles are pivotally related to the playing surface.

3. A game according to claim 1, wherein certain of the missiles are pivotally related to the playing surface and are controlled by a ratchet and pawl mechanism.

* * * * *